US007284465B1

(12) United States Patent
Chen

(10) Patent No.: US 7,284,465 B1
(45) Date of Patent: Oct. 23, 2007

(54) LOCATING STRUCTURE OF AN ADJUSTABLE OPEN WRENCH

(75) Inventor: Joe Chen, Taichung Hsien (TW)

(73) Assignee: Jing-ru Chen, Taichung Hsien (TW)

( * ) Notice: Subject to any disclaimer, the term of this patent is extended or adjusted under 35 U.S.C. 154(b) by 0 days.

(21) Appl. No.: 11/448,665

(22) Filed: Jun. 8, 2006

(51) Int. Cl.
*B25B 13/16* (2006.01)
*B25B 13/20* (2006.01)
*B25B 13/00* (2006.01)

(52) U.S. Cl. ..... 81/165; 81/170

(58) Field of Classification Search ..... 81/155, 81/165, 170, 133
See application file for complete search history.

(56) References Cited

U.S. PATENT DOCUMENTS 1,423,803 A * 7/1922 Illig ..... 81/165
1,484,132 A * 2/1924 Jones ..... 81/165
1,617,488 A * 2/1927 Johnson ..... 81/165
2,719,449 A * 10/1955 Johnson ..... 81/165
2,722,150 A * 11/1955 Green ..... 81/165
2,813,444 A * 11/1957 Hatch, Jr. ..... 81/165
2,849,908 A * 9/1958 Swanstrom et al. ..... 81/165
2,913,942 A * 11/1959 Rozmus ..... 81/165
5,960,683 A * 10/1999 Malkin et al. ..... 81/165
6,116,121 A * 9/2000 Kitt, Jr. ..... 81/170

* cited by examiner

*Primary Examiner*—David B Thomas
(74) *Attorney, Agent, or Firm*—Troxell Law Office, PLLC

(57) ABSTRACT

A locating structure of an adjustable open wrench including: a main body having a handle and a head section, a first end of the head section being fixedly connected with the handle; a first jaw disposed on a second end of the head section; a second jaw slidably disposed on the second end of the head section and linearly reciprocally movable relative to the first jaw for changing a pitch between two opposite faces of the second and first jaws; an adjustment member including a second rack fixedly disposed at one end of the second jaw, a driving threaded rod with a predetermined guide travel being pivotally located in the head section and engaged with the second rack, whereby via the second rack, the driving threaded rod can be rotated to drive the second jaw to linearly move; and a locating member including a locating body disposed in the head section and reciprocally movable between a locating position and a releasing position. When the locating body is positioned in the locating position, the locating body is engaged with the driving threaded rod. When the locating body is positioned in the releasing position, the locating body is disengaged from the driving threaded rod.

5 Claims, 3 Drawing Sheets

10

LOCATING STRUCTURE OF AN ADJUSTABLE OPEN WRENCH

BACKGROUND OF THE INVENTION

The present invention is related to a tool, and more particularly to a locating structure of an adjustable open wrench.

U.S. patent application Ser. No. 11/099,717 of this applicant discloses an adjustable wrench with two movable jaws. In the adjustable wrench, the two jaws are movable away from each other or toward each other. Some characteristics of the above patent application are independently disclosed in the present application.

SUMMARY OF THE INVENTION

It is therefore a primary object of the present invention to provide a locating structure of an adjustable open wrench in which the pitch between the opposite faces of the two jaws can be adjustably fixed at a predetermined dimension.

It is a further object of the present invention to provide the above locating structure of the adjustable open wrench in which the two jaws can be resiliently located in predetermined positions relative to each other.

According to the above objects, the locating structure of the adjustable open wrench of the present invention includes: a main body having a handle with a certain length and a head section, a first end of the head section being fixedly connected with a front end of the handle; a first jaw disposed on a second end of the head section; a second jaw symmetrical to the first jaw and slidably disposed on the second end of the head section, the second jaws being linearly reciprocally movable relative to the first jaw for changing a pitch between two opposite faces of the second and first jaws; an adjustment member including a second rack fixedly disposed at one end of the second jaw, a driving threaded rod with a predetermined guide travel being pivotally located in the head section and engaged with the second rack, whereby via the second rack, the driving threaded rod can be rotated to drive the second jaw to linearly move relative to the first jaw; and a locating member including a locating body disposed in the head section and reciprocally movable between a locating position and a releasing position, whereby when the locating body is positioned in the locating position, the locating body is engaged with the driving threaded rod to prevent the driving threaded rod from rotating, while when the locating body is positioned in the releasing position, the locating body is disengaged from the driving threaded rod, permitting the driving threaded rod to rotate.

The present invention can be best understood through the following description and accompanying drawings wherein:

DETAILED DESCRIPTION OF THE PREFERRED EMBODIMENTS

Figure 1:
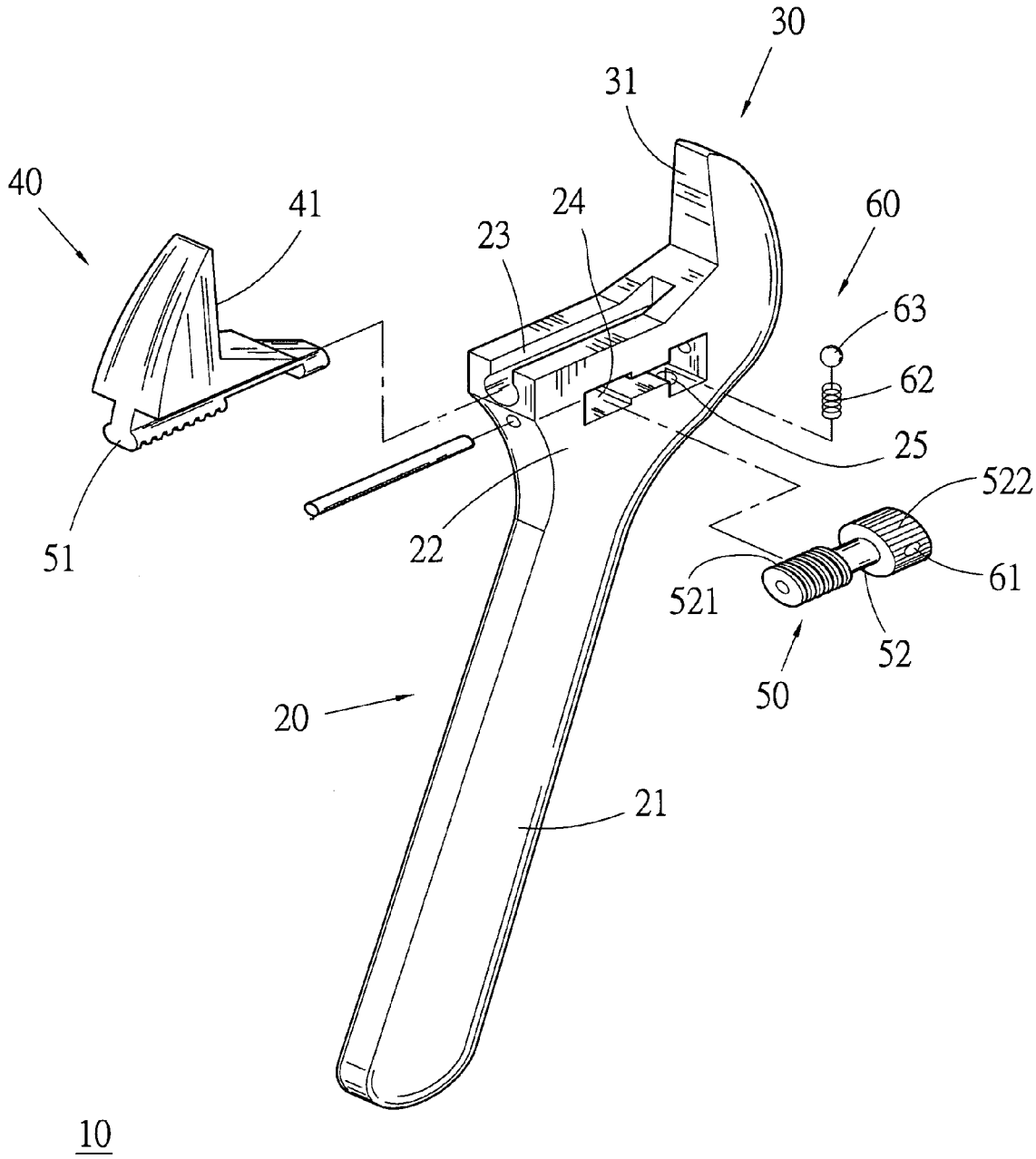
FIG. 1 is a perspective exploded view of a preferred embodiment of the present invention.
Figure 2:
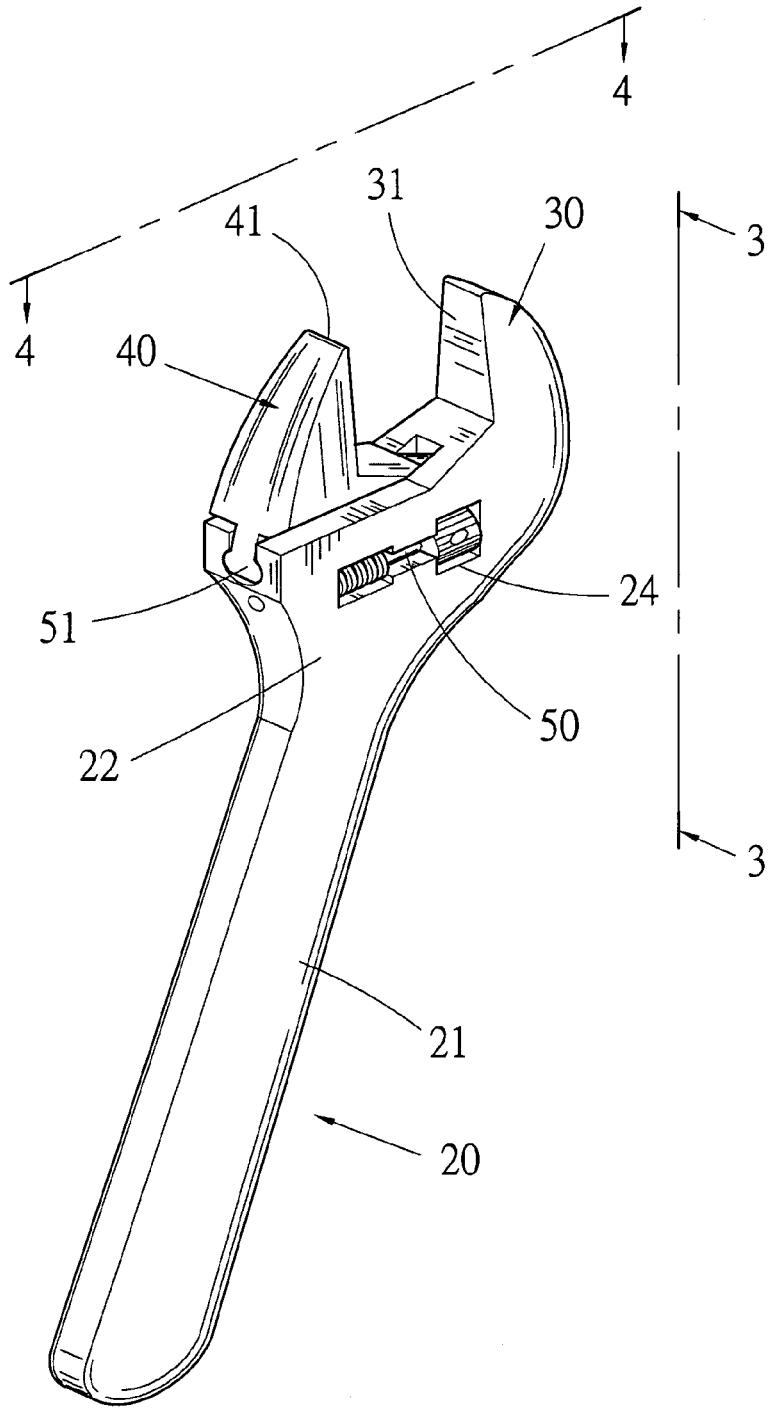
FIG. 2 is a perspective assembled view of the preferred embodiment of the present invention.
Figure 4:
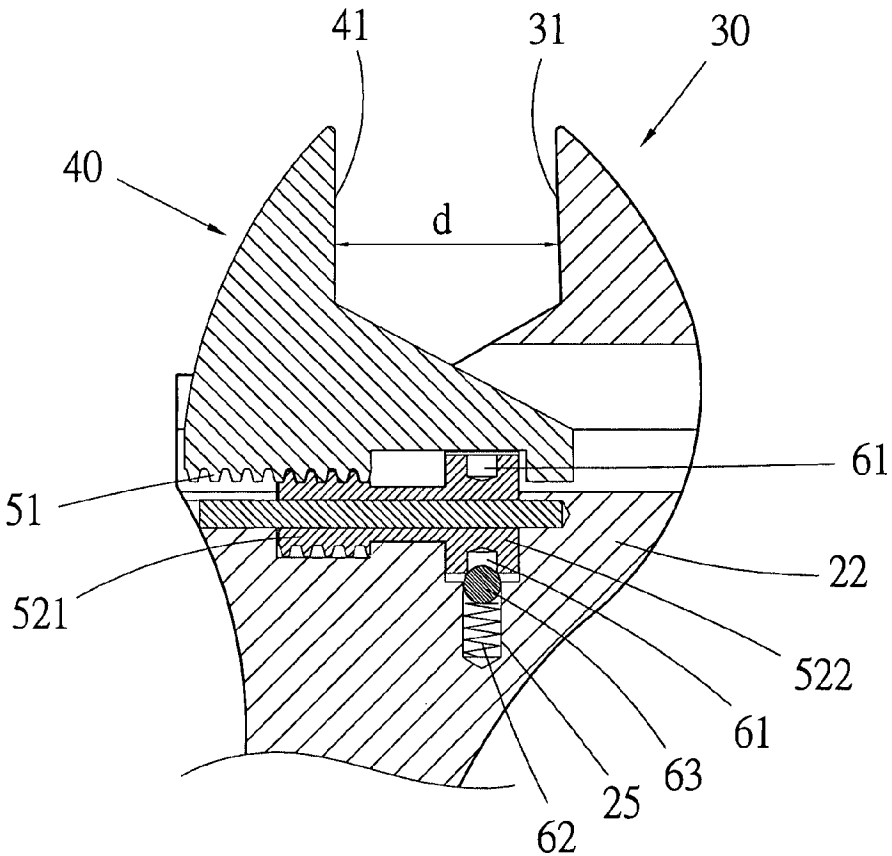
FIG. 4 is a sectional view taken along line 4-4 of FIG. 2.
Figure 3:
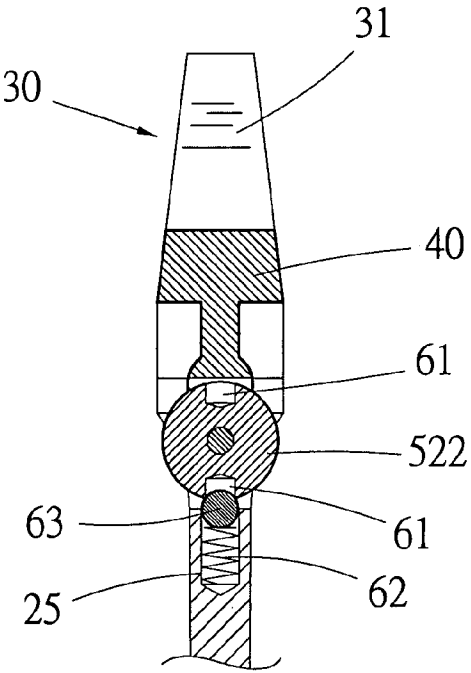
FIG. 3 is a sectional view taken along line 3-3 of FIG. 2.

Please refer to FIGS. 1 to 4. The locating structure 10 of the adjustable open wrench of the present invention includes a main body 20, a first jaw 30, a second jaw 40, an adjustment member 50 and a locating member 60.

The main body 20 has a bar-shaped handle 21 with a certain length and a head section 22. A first end of the head-section 22 is integrally connected with a front end of the handle 21. A second end of the head section 22 is formed with a slide channel 23. In addition, the head section 22 is formed with a slot 24 communicating with the slide channel 23. A blind hole 25 is formed on a wall of the slot 24.

The first jaw 30 is integrally formed on one side of the second end of the head section 22. The second jaw 40 has a shape symmetrical to the shape of the first jaw 30. One end of the second jaw 40 is slidably inlaid in the slide channel 23. Accordingly, the second jaw 40 can be guided by the wall of the slide channel 23 to linearly reciprocally move along the slide channel 23 relative to the first jaw 30. Therefore, the pitch d between the opposite faces 31, 41 of the first and second jaws 30, 40 is adjustable.

The adjustment member 50 includes a second rack 51 fixedly disposed at one end of the second jaw 40 and inlaid in the slide channel 23 corresponding to the slot 24. The second rack 51 is adjacent to the slot 24. A driving threaded rod 52 with a certain guide travel is axially pivotally accommodated in the slot 24. The driving threaded rod 52 is engaged with the second rack 51, whereby via the second rack 51, the driving threaded rod 52 can be rotated to drive the second jaw 40 to linearly move relative to the first jaw 30.

The driving threaded rod 52 is axially sequentially divided into a threaded rod body 521 for engaging with the second rack 51 and a rotary cylindrical body 522 coaxially fixedly connected with one end of the threaded rod body 521 corresponding to an opening of the blind hole 25.

The locating member 60 includes two locating dents 61 oppositely formed on an outer circumference of the rotary cylindrical body 522 at an angular interval of 180 degrees. A spring 62 is accommodated in the blind hole 25 and a ball-shaped locating body 63 is positioned at the opening of the blind hole 25 and resiliently forced by the spring 62, whereby the locating body 63 is reciprocally movable along an axis of the blind hole 25 between a locating position and a releasing position. When the locating body 63 is positioned in the locating position, the locating body 63 is partially inlaid in a corresponding locating dent 61 to resiliently prevent the driving threaded rod 52 from rotating. Under such circumstance, the second jaw 40 is fixed in a certain position.

According to the above arrangement, when the second jaw 40 is located, the pitch d between the first and second jaws 30, 40 is synchronously fixed for wrenching a work piece. Moreover, the driving threaded rod 52 is preset with a certain guide travel regularly corresponding to the common international standard dimension. The rotary cylindrical body 522 can be formed with a predetermined number of locating dents 61 in conformity with the international standard dimension. Accordingly, when the locating body 63 is located in the locating dent 61, it is ensured that the pitch d is compatible with the international standard dimension. In addition, the above locating structure provides an indicating effect, whereby an operator can quickly and precisely adjust the pitch d.

It should be noted that the above structure is not only applicable to the open wrench with only one movable jaw, but also is applicable to the open wrench with two movable jaws. The adjustment member further includes a first rack disposed at one end of the first jaw 30 and inlaid in the slide channel 23. The driving threaded rod is formed with two threads with reverse spiral directions for respectively engaging with the first and second racks. Accordingly, the two jaws are synchronously drivable in reverse directions by the driving threaded rod of the adjustment member.

The above embodiments are only used to illustrate the present invention, not intended to limit the scope thereof. Many modifications of the above embodiments can be made without departing from the spirit of the present invention.

What is claimed is:

1. A locating structure of an adjustable wrench comprising:

a) a main body having:

I) a handle;

ii) a head section having a first end connected to the handle, a slide channel located on a second end thereof, a slot communicating with the slide channel, and a blind hole located in a wall of the slot; and iii) a first jaw located on the second end of the head section;

b) a second jaw having a rack slidably inserted into the slide channel, a pitch between faces of the first jaw and the second jaw is adjustable by a movement of the second jaw relative to the first jaw, the first jaw and the second jaw have symmetrical shapes;

c) an adjustment member controlling the movement of the second jaw and having a driving thread rod having:

I) a threaded rod body located on a first end thereof and engaging the rack of the second jaw; and ii) a rotary cylindrical body located on a second end thereof and having at least one dent located on an outer periphery thereof, both the threaded rod body and the rotary cylindrical body are rotatably located in the slot of the head section and are exposed to an exterior of the head section through the slot, the at least one dent of the rotary cylindrical body aligning with the blind hole of the slot; and d) a locating member located in the blind hole of the slot of the head section and being movable between locating and releasing positions, wherein, when the locating member is located in the releasing position, the locating member is separated from the at least one dent, and, when the locating member is located in the locating position, the locating member is engaged with one of the at least one dent.

2. The locating structure according to claim 1, wherein the locating member includes a spring and a locating body, the spring pressing the locating body against the rotary cylindrical body of the adjustment member.

3. The locating structure according to claim 1, wherein the locating body is a ball shaped body.

4. The locating structure according to claim 1, wherein the at least one dent is at least two dents equally spaced apart on the outer periphery rotary cylindrical body.

5. The locating structure according to claim 1, wherein the slot is located in a middle section of a surface of the head section spaced apart from peripheral edges of the head section.

* * * * *